US007647801B2

(12) United States Patent
Cheppe et al.

(10) Patent No.: US 7,647,801 B2
(45) Date of Patent: Jan. 19, 2010

(54) SHOT, DEVICES, AND INSTALLATIONS FOR ULTRASONIC PEENING, AND PARTS TREATED THEREBY

(75) Inventors: Patrick Cheppe, Basse-Goulaine (FR); Vincent Desfontaine, Saint Lumine de Coutais (FR); Jean-Michel Duchazeaubeneix, Les Sorinieres (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 12/498,179

(22) Filed: Jul. 6, 2009

(65) Prior Publication Data

US 2009/0288463 A1 Nov. 26, 2009

Related U.S. Application Data

(63) Continuation of application No. 12/109,306, filed on Apr. 24, 2008, which is a continuation of application No. 11/184,927, filed on Jul. 20, 2005, now abandoned.

(60) Provisional application No. 60/599,364, filed on Aug. 6, 2004.

(30) Foreign Application Priority Data

Jul. 30, 2004 (FR) ..... 04 08493

(51) Int. Cl.
*B21D 26/02* (2006.01)
*B23Q 17/00* (2006.01)

(52) U.S. Cl. ..... 72/53; 72/430; 72/707; 29/90.7; 451/38; 451/39

(58) Field of Classification Search ..... 72/53, 72/430, 707; 29/90.7; 451/38, 39
See application file for complete search history.

(56) References Cited

U.S. PATENT DOCUMENTS

| | | | |
|---|---|---|---|
| 3,695,091 | A | 10/1972 | Smith |
| 4,115,076 | A | 9/1978 | Hitzrot, Jr. |
| 4,354,371 | A | 10/1982 | Johnson |
| 4,386,458 | A | 6/1983 | Evans |
| 4,713,882 | A | 12/1987 | Bianchi et al. |
| 5,085,747 | A | 2/1992 | Nikano |
| 5,107,631 | A | 4/1992 | Wern |
| 5,443,201 | A | 8/1995 | Cartry |
| 5,509,286 | A | 4/1996 | Coulon |
| 5,820,011 | A | 10/1998 | Ito et al. |
| 5,829,116 | A | 11/1998 | Vilon |
| 5,950,470 | A | 9/1999 | Prewo et al. |
| 6,170,308 | B1 | 1/2001 | Veronesi et al. |

(Continued)

FOREIGN PATENT DOCUMENTS

DE 40 41 365 A1 7/1992

(Continued)

*Primary Examiner*—David B Jones
(74) *Attorney, Agent, or Firm*—Oliff & Berridge, PLC

(57) ABSTRACT

A system for ultrasonically peeing surfaces includes a sonotrode comprising a body material and a vibrating surface, the vibrating surface coated with a coating material having a hardness greater than the body material, a treatment chamber defined at least in part by the vibrating surface, and at least one piece of shot within the treatment chamber to be excited by the vibrating surface of the sonotrode, the at least one piece of shot having a hardness greater than or equal to 800 HV.

20 Claims, 4 Drawing Sheets

U.S. PATENT DOCUMENTS

| | | | | |
|---|---|---|---|---|
| 6,289,705 | B1 | 9/2001 | Duquenne et al. | |
| 6,336,844 | B1 | 1/2002 | Duquenne et al. | |
| 6,343,495 | B1 | 2/2002 | Cheppe | |
| 6,467,321 | B2 | 10/2002 | Prokopenko et al. | |
| 6,490,899 | B2 | 12/2002 | Berthelet et al. | |
| 6,505,489 | B2 | 1/2003 | Berthelet et al. | |
| 6,508,093 | B2 | 1/2003 | Berthelet et al. | |
| 6,536,109 | B2 | 3/2003 | Berthelet et al. | |
| 6,862,913 | B2 * | 3/2005 | Lempenauer et al. | 72/430 |
| 7,389,663 | B2 | 6/2008 | Cheppe et al. | |
| 7,582,174 | B2 * | 9/2009 | Vigneau | 72/53 |
| 2003/0115922 | A1 | 6/2003 | Berthelet et al. | |

FOREIGN PATENT DOCUMENTS

| | | |
|---|---|---|
| FR | 2 815 280 | 4/2002 |
| FR | 2 815 281 | 4/2002 |
| GB | 2 250 931 A | 6/1992 |
| JP | 07-308859 | 11/1995 |
| SU | A 1 447 888 | 12/1988 |
| WO | WO 95/17994 | 7/1995 |

* cited by examiner

Fig.1
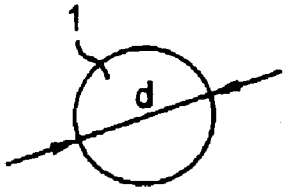
Fig.2
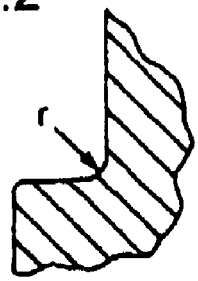
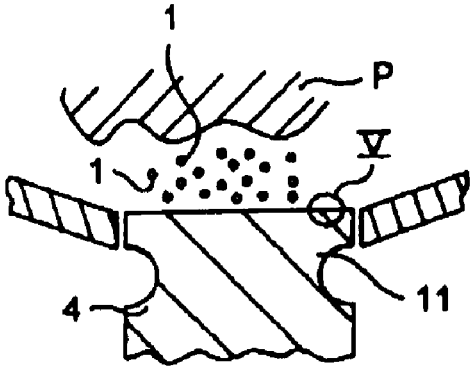
Fig.4
Fig.3
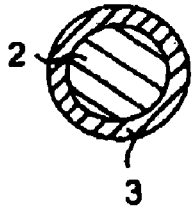
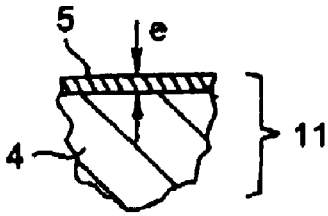
Fig.5
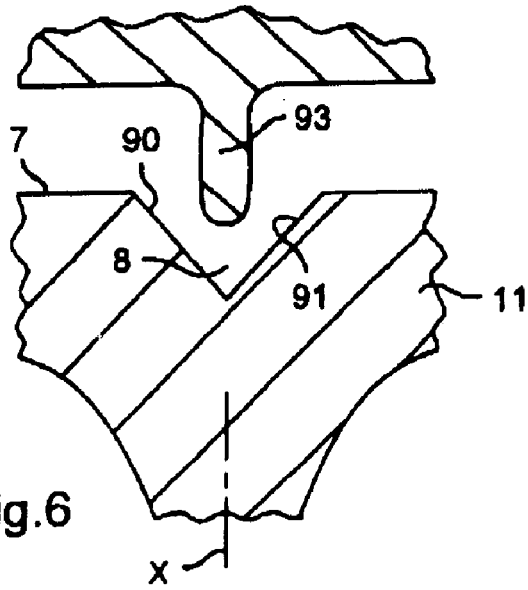
Fig.6

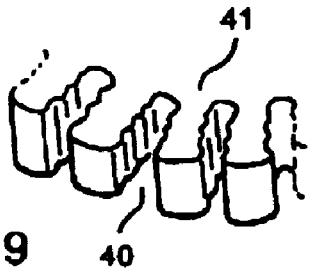
Fig.9
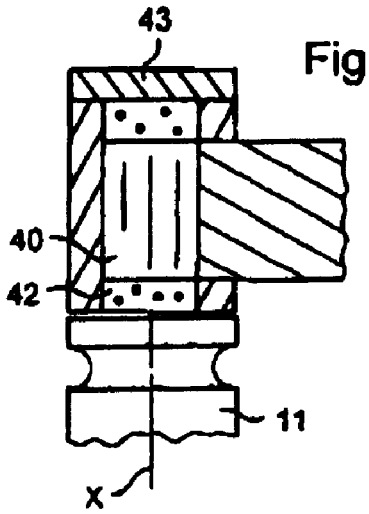
Fig.10
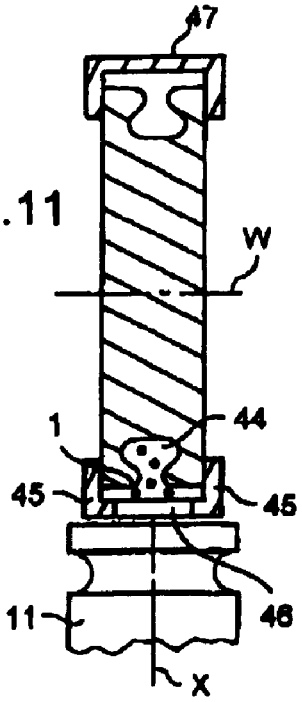
Fig.11
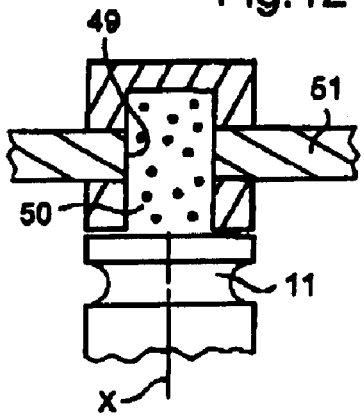
Fig.12
Fig.13
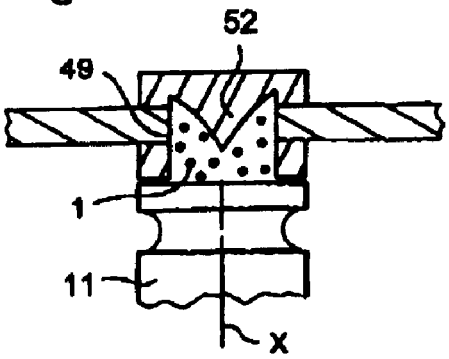
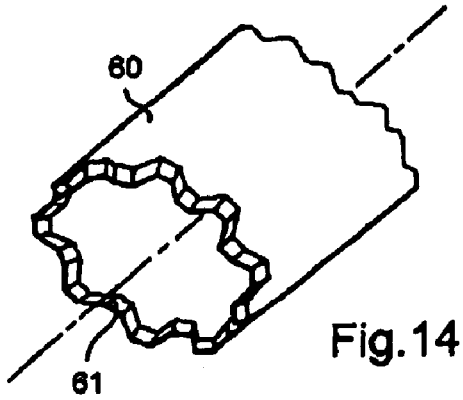
Fig.14

SHOT, DEVICES, AND INSTALLATIONS FOR ULTRASONIC PEENING, AND PARTS TREATED THEREBY

This application is a continuation of application Ser. No. 12/109,306, filed Apr. 24, 2008, which in turn is a continuation of application Ser. No. 11/184,927, filed Jul. 20, 2005, now abandoned which in turn claims the benefit of French Application No. 04 08493 filed on Jul. 30, 2004 and U.S. Provisional Application No. 60/599,364 filed on Aug. 6, 2004. The entire disclosure of each of the prior applications is incorporated herein by reference in its entirety.

The present invention relates to shot, devices, and installations for ultrasonic peening, and also to parts thus treated by peening.

BACKGROUND

Methods and installations for ultrasonic peening are described in particular in French patents FR 2 815 280 and FR 2 815 281, using at least one sonotrode comprising a titanium body for putting shot into motion for inducing compression stresses in the treated part.

The following publications also relate to ultrasonic peening: U.S. Pat. No. 6,490,899 B2, U.S. Pat. No. 6,343,495 B1, U.S. Pat. No. 6,467,321 B2, U.S. Pat. No. 6,336,844 B1, U.S. Pat. No. 6,289,705 B1, U.S. Pat. No. 6,508,093 B2, US 2003/0115922 A1, U.S. Pat. No. 6,505,489 B2, and U.S. Pat. No. 6,536,109 B2.

The shot used and described in the past in those patents mainly comprises steel balls having a diameter of about 2 millimeters (mm) for example. The use of such shot does not enable treatment to be sufficiently intense on concave surfaces that present a radius of curvature smaller than that of the balls, or in the bottoms of certain setbacks.

SUMMARY

In a first of its aspects, the present invention seeks to remedy that drawback, and it achieves this by means of shot for use in a peening installation, in particular an ultrasonic peening installation in which the shot is propelled by at least one sonotrode, the shot being characterizable by the fact that it presents:

- hardness greater than or equal to a Vickers hardness number 800 HV, preferably greater than or equal to 1300 HV;
- density greater than or equal to 8 grams per cubic centimeter ($g/cm^3$), better greater than or equal to 12 $g/cm^3$; and
- pieces having a maximum dimension less than or equal to 1.5 mm.

The use of such shot makes it possible to treat zones that are difficult to access using conventional pieces having small radii of curvature, and in particular less than 1.5 mm, the shot nevertheless being capable of acquiring sufficient kinetic energy to generate the desired level of stress in the part and remaining compatible with the use of a sonotrode.

The pieces of shot are preferably substantially spherical, in particular with maximum tolerance of ±60 micrometers (μm) on sphericity.

The shot preferably comprises at least one non-ferrous material at its surface, advantageously tungsten carbide (WC). The shot may be made entirely out of tungsten carbide.

Furthermore, the presence of iron in conventional steel shot for prior art peening installations leads to a ferrous deposit being formed on the treated part and/or to encrustations that must subsequently be eliminated, since otherwise they will oxidize, and that requires parts to be cleaned after they have been peened. The cleaning operation is also known as decontamination and it is performed in baths. For example, chemical etching baths are used, but they also lower the level of residual stresses and reduce the fatigue strength of the part.

In another of its aspects, the invention seeks to avoid that additional treatment, thereby maintaining the fatigue strength of the treated part.

The invention achieves this by means of shot for use in a peening installation, in particular a peening installation in which the shot is set into motion by at least one sonotrode, the shot comprising at least one non-ferrous material at its surface, and presenting density greater than or equal to 3 $g/cm^3$, better greater than or equal to 12 $g/cm^3$.

The non-ferrous material is advantageously tungsten carbide (WC).

In another of its aspects, independently or in combination with the above, the invention provides shot for use in a peening installation, in particular an installation for ultrasonic peening and including at least one sonotrode, each piece of shot comprising:

- a core made of at least one first material; and
- at least one second material different from the first in a shell surrounding the core.

Such composite pieces of shot can make it possible, for example, to make the core out of a material that is less expensive than the material used for making the shell, thereby contributing to reducing costs. This can also make it possible for the core to be made of a material of greater density, but presenting insufficient hardness.

Preferably, the second material presents hardness greater than that of the first, in particular hardness greater than or equal to 800 HV, better greater than or equal to 1300 HV, and also preferably the second material is a non-ferrous material, e.g. tungsten carbide (WC).

In another of its aspects, individually or in combination with the above, the invention also provides a peening device having at least one sonotrode for setting at least one piece of shot into motion, in particular shot as defined above, said sonotrode presenting at least one face for coming into contact with the shot, the device being characterizable by the fact that the sonotrode has a metal body, preferably made of titanium, coated in a deposit of a material that is not as hard as the base metal, to a thickness greater than or equal to 0.5 mm, and advantageously based on tungsten carbide.

Such a device makes it possible to obtain a sonotrode having much greater resistance to wear (abrasion), in particular when using shot presenting the above-defined characteristics, but without harming the acoustic operation of the sonotrode.

The thickness is preferably greater than or equal to 0.75 mm, e.g. lying in the range 0.9 mm to 1.1 mm.

In another of its aspects, independently or in combination with the above, the invention also provides a device for treating at least one part by peening, the device comprising at least one sonotrode for setting at least one piece of shot into motion, e.g. shot as defined above, said sonotrode comprising a body made at least in part out of titanium, the device being characterizable by the fact that the body is made at least in part and preferably entirely out of forged titanium.

The Applicant has found that forged titanium can be used for fabricating a sonotrode, thus making it possible for example to diversify sources of supply in the event of there being a shortage of titanium obtained by rolling, as has been used until now for fabricating sonotrodes.

In this particular aspect, the invention is not limited to sonotrodes used for ultrasonic peening, and it can be applied to sonotrodes used for ultrasonic welding. The invention thus also provides a sonotrode considered in isolation and made at least in part out of forged titanium.

In another of its aspects, independently or in combination with the above, the invention also provides a device for treating at least one part by peening, the device comprising at least one sonotrode and a treatment chamber in which shot is set into motion by the sonotrode, wherein the chamber includes at least one wall or projection for coming to bear against the part for treatment.

Such a device may present the advantage of enabling pieces of shot of relatively small size to be used, without any fear of them becoming engaged in an opening in the treated part, for example, with such an opening being closed by the wall or projection, and with the advantage of defining treatment zones, thereby avoiding the need for masking and demasking operations.

In another of its aspects, independently or in combination with the above, the invention also provides a device for treating at least one part by peening, the device comprising at least one sonotrode and a treatment chamber in which shot can be set into motion by the sonotrode, the device including a filler element of shape that matches substantially the shape of a face of the part for treatment that faces away from the sonotrode.

Such a filler element can serve to accelerate the return of shot to the sonotrode or to avoid some shot failing to return to the sonotrode.

In another of its aspects, independently or in combination with the above, the invention also provides an installation for peening a part for treatment, the installation comprising:

at least one sonotrode; and at least one piece of shot presenting a surface made of non-ferrous material, the amplitude of vibration of the sonotrode being selected in such a manner as to induce in the part for treatment stresses that correspond to an ALMEN intensity of at least F8A.

In another of its aspects, independently or in combination with the above, the invention also provides a device for peening at least one part for treatment, the device comprising a sonotrode for propelling shot against the part for treatment, said sonotrode having at least one cavity in which a portion of the part for treatment is engaged. The part for treatment is thus not engaged inside said cavity.

By way of example, the cavity is made in a substantially plane end face of the sonotrode.

Such a device makes it easier and quicker to treat parts that have projecting portions, which portions can be engaged in part in the sonotrode cavity, thereby reducing treatment time.

The path between the vibrating surface of the sonotrode and the treated part can be shortened and, for example, the cavity can be made to have inclined faces contributing to directing the shot towards certain zones of the part for treatment, which zones would otherwise be more difficult to reach, and/or contributing to reducing the angle of incidence of the shot, thereby increasing its impact force and reducing treatment time.

The invention also provides a peening installation comprising a sonotrode and at least one piece of shot as defined above. In such an installation, the sonotrode is excited, for example, at a frequency lying in the range 10 kilohertz (kHz) to 60 kHz, e.g. a frequency of about 15 kHz, 20 kHz, or 40 kHz.

Furthermore, U.S. Pat. No. 6,536,109 teaches treating a plurality of blade roots by peening, with the roots being placed in an enclosure, and the longitudinal axes of the blades being directed parallel to the longitudinal axis of the sonotrode.

In another of its aspects, the invention seeks to further improve the treatment of blade roots.

The invention achieves this by means of a method of treating at least one blade root in a peening installation, the blade having a longitudinal axis, the peening installation comprising a peening device comprising a sonotrode with a longitudinal axis and shot set into motion by the sonotrode, the method being characterizable by the fact that the root is placed in such a manner that the longitudinal axis of the blade is substantially perpendicular to the longitudinal axis of the sonotrode.

An elastically-deformable endpiece may be placed against an end face of the blade root, situated substantially opposite from the blade.

Advantageously, the space situated behind the side face of the root that is facing away from the sonotrode is filled with a filler element of a shape that substantially matches the shape of said face.

In another of its aspects, independently or in combination with the above, the invention also provides a part treated in a peening installation using at least one piece of shot as defined above, the part presenting a peened surface free from any ferrous deposit or encrustation and having at least one concave portion with a radius of curvature less than or equal to 1.5 mm, in particular less than or equal to 0.7 mm. The peened surface preferably presents a stress level having an ALMEN intensity greater than or equal to F8A.

In another of its aspects, independently or in combination with the above, the invention also provides a device for peening a part having cells that open out radially in its periphery, the device comprising a treatment chamber that is open to the sonotrode, said treatment chamber allowing a peripheral region of the part that includes the cells to pass therethrough, the part being driven to rotate relative to the sonotrode about an axis substantially parallel to the longitudinal axis of the sonotrode.

In another of its aspects, independently or in combination with the above, the invention also provides a device for peening a part having a peripheral annular groove, in particular a groove presenting a cross-section with a constriction, the device comprising a treatment chamber having side walls disposed on either side of the part, in particular side walls covering the side faces of the part, an end wall uniting the side walls, said end wall being pierced by an opening that opens out to the sonotrode so as to enable shot to impact the sonotrode and be set into motion thereby inside the treatment chamber, the treatment chamber being disposed in such a manner as to be capable of allowing the part to pass therethrough, the part being driven to rotate about an axis substantially perpendicular to the longitudinal axis of the sonotrode.

In another of its aspects, independently or in combination with the above, the invention also provides a peening device comprising a treatment chamber open to a sonotrode and a deflector for deflecting shot present in the treatment chamber and set into motion by the sonotrode so that they are directed towards the surface for treatment.

By way of example, the deflector may be conical in shape so as to enable a tubular wall to be treated, e.g. a through hole. By way of example, the treatment chamber may be defined between a top portion comprising the deflector and a bottom portion comprising the sonotrode.

In another of its aspects, independently or in combination with the above, the invention also provides a device for peening a cylindrical part provided at one end with a set of teeth, the device comprising a sonotrode and a treatment chamber through which the teeth pass, the part being driven to rotate about an axis perpendicular to the longitudinal axis of the sonotrode, the treatment chamber including a deflector for deflecting the shot towards the bottoms of the grooves formed between the teeth in the set.

In a variant, the part is driven to rotate about an axis that is substantially parallel to the longitudinal axis of the sonotrode, and the treatment chamber includes sloping walls for deflecting the shot towards the radially-inner and radially-outer faces of the teeth in the set.

In another variant, the set of teeth is fully engaged in the treatment chamber, which chamber may include a central conical deflector enabling shot to be deflected towards the radially-inner surfaces of the teeth in the set, and a peripheral deflector enabling the shot to be deflected towards the radially-outer surfaces of the teeth in the set. The part may be optionally driven relative to the sonotrode about an axis that is substantially parallel to the longitudinal axis of the sonotrode.

In another of its aspects, independently or in combination with the above, the invention also provides a device for peening a part including a tapped hole, the device comprising a sonotrode and a treatment chamber defined at least in part by a deflector that is inserted inside the tapped hole, said deflector including a wall that is inclined relative to the longitudinal axis of the sonotrode so as to deflect shot towards a thread of the tapped hole. The axis of the sonotrode may be substantially parallel to the axis of the tapped hole. Means may be provided for causing the deflector to move relative to the part for treatment. The part for treatment may be driven in rotation about the longitudinal axis of the sonotrode, for example.

BRIEF DESCRIPTION OF THE DRAWINGS

The invention can be better understood on reading the following detailed description of non-limiting embodiments thereof, and on examining the accompanying drawings, in which:

FIG. 1 is a diagrammatic view of an example of a piece of shot in one aspect of the invention;

FIG. 2 is a fragmentary and diagrammatic section view of a part having a concave portion presenting a small radius of curvature;

FIG. 3 is a cross-section in a midplane of a piece of composite shot in accordance with another aspect of the invention;

FIG. 4 is a diagrammatic and fragmentary view of a peening installation in another aspect of the invention;

FIG. 5 shows a detail V of FIG. 4;

FIG. 6 is a diagrammatic and fragmentary axial section view of a sonotrode made in accordance with another aspect of the invention;

FIG. 9 is a diagrammatic and fragmentary view of an example of a part for treatment;

FIG. 10 is a diagrammatic view of a peening installation suitable for use in treating the FIG. 9 part;

FIGS. 11 to 13 show other examples of a peening installation;

FIG. 14 is a diagrammatic and fragmentary view of another example of a part for treatment;

DETAILED DESCRIPTION

Shot

Figure 7:
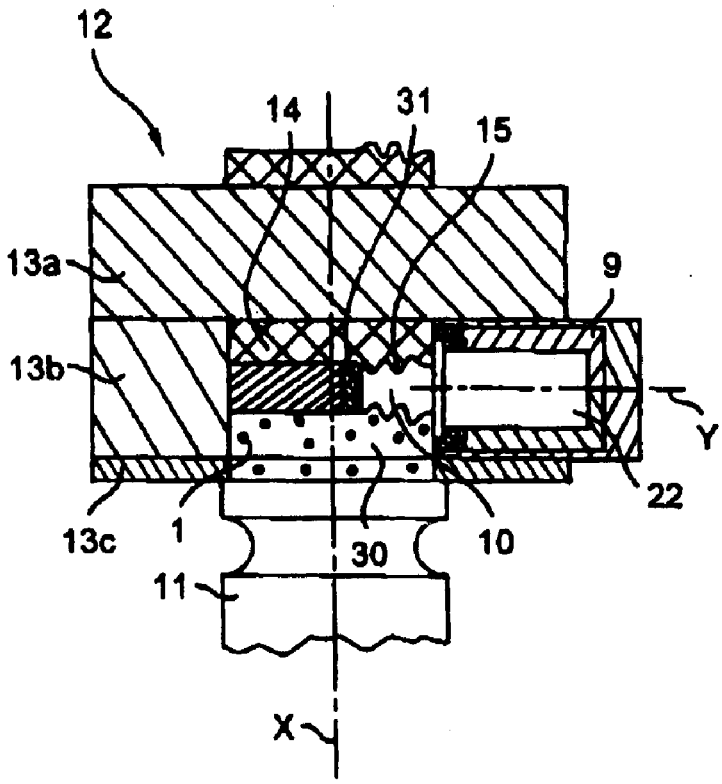
FIGS. 7 and 8 are diagrammatic and fragmentary views of an installation for peening blade roots in accordance with another aspect of the invention.

In one of its aspects, the invention relates to shot for use in a peening installation comprising a sonotrode that is set into vibration at ultrasound frequencies by a suitable generator. The shot may be characterized by hardness greater than or equal to 800 HV, density greater than or equal to 8 g/cm$^3$, and pieces having a maximum dimension that is less than or equal to 1.5 mm.

FIG. 1 shows a piece of shot 1 satisfying this definition, and that is substantially spherical shape, with the above-mentioned maximum dimension corresponding to the diameter d of the sphere. Preferably, the tolerance on its sphericity is better than ±60 μm.

Its hardness is preferably greater than or equal to 1300 HV, and its density is preferably greater than or equal to 12 g/cm$^3$.

By way of example, the shot 1 is made entirely out of tungsten carbide or any other material presenting the required hardness and density. The tungsten carbide includes a binder of cobalt or nickel, for example.

The material used is preferably non-ferrous, thereby presenting the advantages explained above.

In an embodiment of the invention, the piece of shot 1 is a ball of diameter d equal to 0.91 mm, and made of tungsten carbide (WC). By way of example, such a piece of shot is used in an ultrasonic peening installation and is propelled by the vibrating surface of a sonotrode in which the amplitude of vibration lies, for example, in the range 60 μm to 80 μm, approximately, so that the kinetic energy of the shot impacting against the part for treatment can generate stresses presenting an ALMEN intensity of least F8A once the part has been treated.

By way of example, the excitation frequency of the sonotrode lies in the range 10 kHz to 60 kHz, e.g. 20 kHz. The frequency may be selected as a function of the characteristics of the zone to be treated and of the characteristics of the required treatment, for example.

The small size of the piece of shot 12 makes it possible to treat concave surfaces having a radius of curvature r that is relatively small, as shown in FIG. 2, e.g. a radius of curvature r less than or equal to 0.7 mm.

In another aspect of the invention, the shot 1 may be composite, as shown in FIG. 3, e.g. each piece comprising a core 2 of a first material and a shell 3 of a second material, preferably harder than the first and non-ferrous, the hardness of the second material being greater than or equal to 800 HV, and better greater than or equal to 1300 HV, for example, and said second material preferably being tungsten carbide.

By way of example, the core may be made of steel, of uranium, or of any other material that is compatible with having the second material deposited thereon and with obtaining the compression stresses that are generated by peening.

Sonotrodes

In accordance with another aspect of the invention, as shown in FIGS. 4 and 5, the sonotrode 11 used for setting the shot 1 into motion, in particular the above-mentioned tungsten carbide shot, may comprise a body 4 made of titanium, coated on its side that is to be impacted by the shot in a deposit 5 of material that is harder than titanium, to a thickness e that is greater than or equal to 0.5 mm. The outside surface of the deposit is preferably prepared (rectified or machined) so as to return the sonotrode to its initial shape. By way of example, the material constituting the deposit 5 is tungsten carbide deposited on the titanium by any suitable method, in particular by a method implemented by the French supplier TECHNOGENIA (Saint Joriez). The thickness e may be greater than or equal to 0.75 mm, for example, and better greater than or equal to 0.9 mm, e.g. being about 1 mm.

In another aspect of the invention, the body 4 of the sonotrode can be made, independently of the optional presence of the deposit 5, at least in part out of forged titanium, e.g. titanium Ti 10.2.3. Forged titanium withstands the internal stresses induced by the ultrasonic vibration while the sonotrode is in operation.

In another aspect of the invention, shown in FIG. 6, the vibrating face 7 of the sonotrode 11 that is impacted by the shot may present at least one cavity 8 in which the part 93 to be treated is partially engaged. The vibrating face 7, with the exception of the cavity 8, is plane, for example, extending substantially perpendicularly to the longitudinal axis X of the sonotrode 11.

By way of example, the portion of the part 9 that is engaged in the cavity 8 may be a blade root or platform, or a shoulder on a shaft.

By way of example, the cavity 8 is defined by sloping walls 90 and 91 which may form a V-shape when the portion of the part 9 being treated is substantially rectilinear, for example.

The inclination of the walls 90 and 91 enables the shot to reach the opposite faces of the portion of the part 9 that is engaged in the cavity 9 at a smaller angle of incidence.

Peening Installations

The peening installations to which the invention applies comprise at least one sonotrode and at least one piece of shot set into motion by the sonotrode so as to impact against the part for treatment, either directly or after being reflected on at least one deflector, which may be constituted by a wall of the treatment chamber, for example.

By way of example, the shot may be one of the varieties defined above, in particular being made out of tungsten carbide, or out of steel, or having a composite structure.

The amplitude of vibration of the sonotrode is selected so as to induce stresses in the part for treatment that corresponds to an ALMEN intensity greater than or equal to F8A, for example. This amplitude preferably lies in the range 1 μm to 300 μm.

Depending on the nature and in particular on the shape of the part for treatment, the peening installation may present a variety of configurations.

Figure 8:
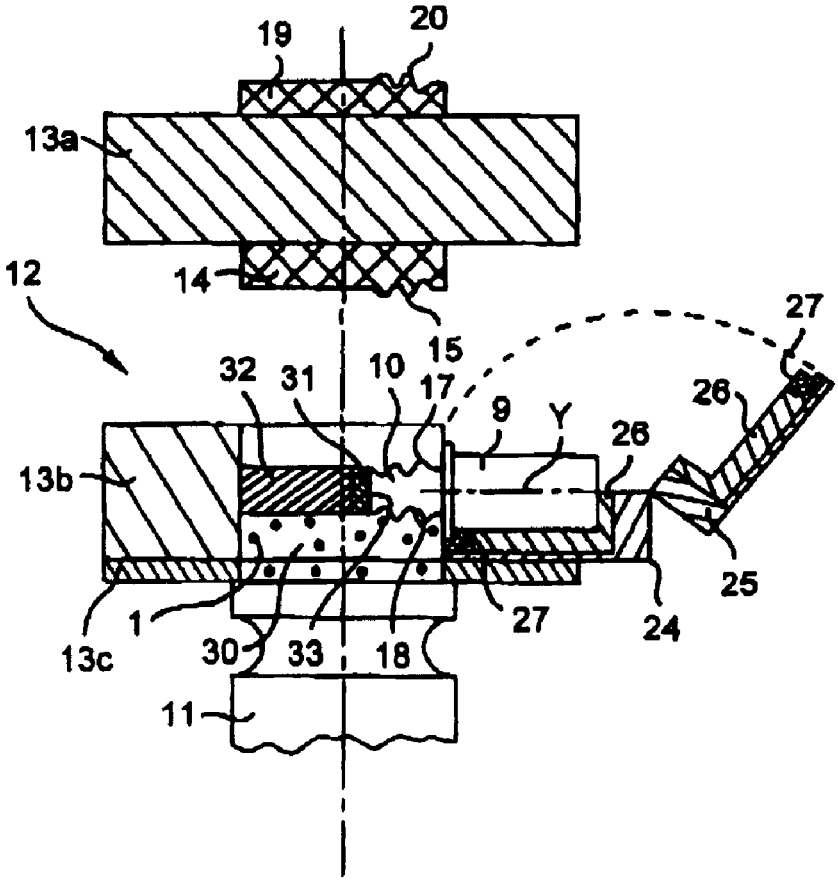

When the part for treatment is a blade, for example, having a longitudinal axis Y as shown in FIGS. 7 and 8, and including a root 10 for enabling it to be fastened to a support of annular shape, then the blade 9 is preferably oriented with its longitudinal axis Y substantially perpendicular to the longitudinal axis X of the sonotrode 11, thus making it easier to treat the side faces 17 and 18 of the root 10.

For such a part, the shot that is used is preferably made up of small tungsten carbide balls of diameter less than or equal to 1.2 mm, e.g. about 0.91 mm.

In this example, the installation 12 advantageously includes a removable portion 13*a* supporting a filler element 14 presenting a portion 15 of shape matching the shape of the side face 17 that faces away from the sonotrode, a movable portion 13*b* and a stationary portion 13*c* placed above the sonotrode 11 at a distance that is less than the diameter of a piece of shot, and preferably substantially equal to one-third the shot diameter.

The function of the stationary portion 13*c* is to keep shot at rest on the sonotrode so as to leave the portions 13*a* and 13*b* free for handling without running any risk of dispersing shot outside the treatment chamber 30.

Where appropriate, the removable portion 13*a* may have a second filler element 19 presenting a portion 20 of shape that matches that of the other side face 18 so as to enable the side face 17 to be treated after the removable portion 13*b* has been turned over.

This portion is held in place in a housing 22 defined in the example being described between two portions 24 and 25 that are capable of being displaced relative to each other, e.g. by being pivoted, as shown. The inside face of each of the portions 24 and 25 that comes into contact with the blade 9 may be defined by a removable portion 26 of shape that matches that of the blade 9, thus enabling the installation to be adapted to other parts for treatment merely by changing the removable portion 26.

The portions 24 and 25 may also include gaskets 27 of elastically-deformable material, these gaskets 27 serving to close the treatment chamber 30 in shot-tight manner.

In particular when the root 10 includes at least one opening in its end face 33 remote from the blade 9, an endpiece 31 of elastically-deformable material may be pressed against said end face 33, specifically for preventing shot from penetrating into the above-mentioned opening(s). The endpiece 31 may be secured to the end of a support 32, e.g. made of a synthetic material that withstands impacts from the shot throughout the duration of treatment to the root 10.

Naturally, the invention may be applied to a wide variety of parts.

In the example shown in FIGS. 9 and 10, the part 41 for treatment presents cells 40 that are distributed around its circumference.

This part 41 can be driven in rotation about an axis of rotation parallel to the longitudinal axis of the sonotrode 11, the cells 40 passing through a treatment chamber 42 having its bottom closed by the sonotrode 11 and its top closed by a wall 43 that is suitable for being replaced by the sonotrode 11 so as to enable the opposite face to be treated simultaneously.

For a part presenting an annular groove 44 in its periphery, as shown in FIG. 11, the installation may comprise, for example, side walls 44 that cover the sides of the parts to be treated and an end wall 47 for interconnecting the side walls 45 and closing the treatment chamber 44, said wall 47 being pierced by an opening 46 enabling the shot 1 set into motion by the sonotrode 11 to impact against the part that is to be treated.

By way of example, this part may be driven to rotate about an axis W placed perpendicular to the longitudinal axis X of the sonotrode.

In order to treat the inside edge 49 of a hole 50 in a part 51, as shown in FIG. 12, it is possible for example to provide a treatment chamber 50 that is closed at its top end and that opens out at its bottom end to the vibrating face of the sonotrode 11.

Where appropriate, and as shown in FIG. 13, it is possible to make the treatment chamber with at least one central deflector 52, e.g. of conical shape, so that by bouncing against the deflector, the shot can reach the edge 49 at a smaller angle of incidence.

Figure 15:
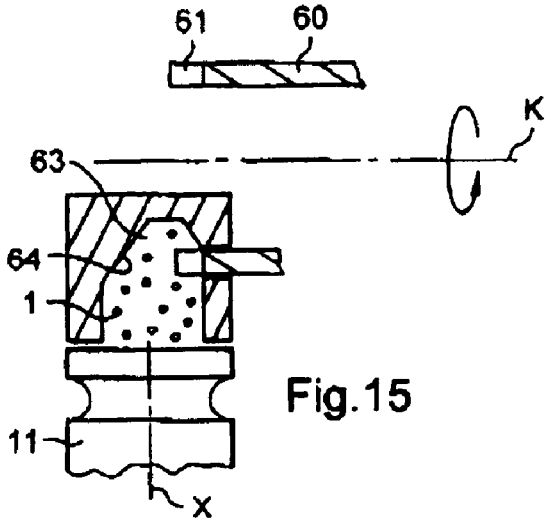
FIGS. 15 to 17 show examples of peening installations suitable for use in treating the FIG. 15 part.
Figure 16:
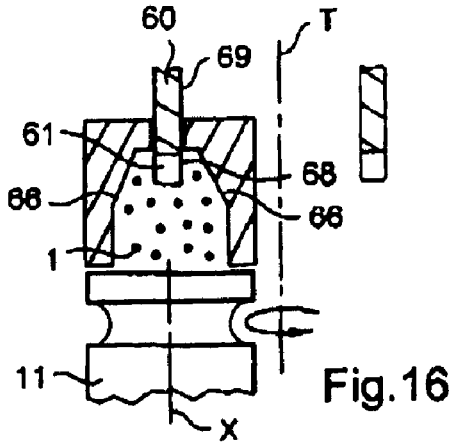
Figure 17:
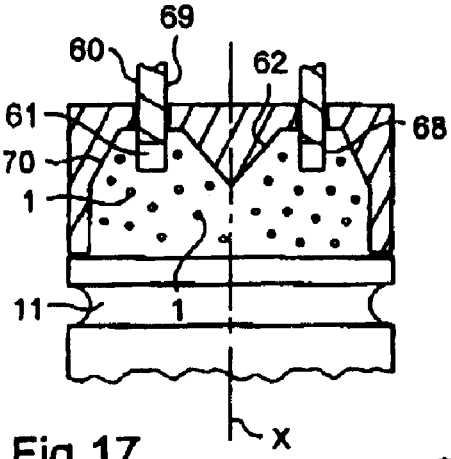

In order to treat a part 60 that is, for example, cylindrical in shape with one end carrying a set of teeth 61, also known as a dog or curvic coupling, as shown in FIG. 14, it is possible to use one of the installations shown in FIGS. 15 to 17, for example.

In the configuration of FIG. 15, the part 60 is driven to rotate about an axis K that is perpendicular to the longitudinal axis X of the sonotrode 4, and the peening treatment of the set of teeth 61 is performed by causing said set of teeth to pass through a treatment enclosure 63 having an obliquely sloping wall 64 for deflecting shot coming from the vibratory surface of the sonotrode 11 into the bottoms of the grooves formed between the teeth, the wall 64 sloping at an angle of substantially 45°, for example, relative to the longitudinal axis X of the sonotrode 11.

In the configuration of FIG. 16, the part 60 is driven in rotation about an axis T that is parallel to the axis X of the sonotrode 11, the bottoms of the grooves formed between the teeth in the set 61 facing the vibrating surface of the sonotrode 11.

The treatment chamber may include walls 66 that slope obliquely relative to the longitudinal axis X of the sonotrode so as to deflect the shot towards the radially-outer and radially-inner faces 68 and 69 respectively of the teeth in the set 61.

In the configuration of FIG. 17, the sonotrode 11 is large enough to treat all of the teeth in the set 61 simultaneously, the treatment chamber presenting, for example, a conical deflector 62 in its center enabling the shot to be deflected towards the radially-inner face 69 of the part 60.

The treatment chamber may also present a peripheral wall 70 of conical shape, enabling the shot to be deflected towards the radially-outer face 68 of the part 60. The part may optionally be driven in rotation about an axis coinciding with the longitudinal axis X of the sonotrode.

Figure 18:
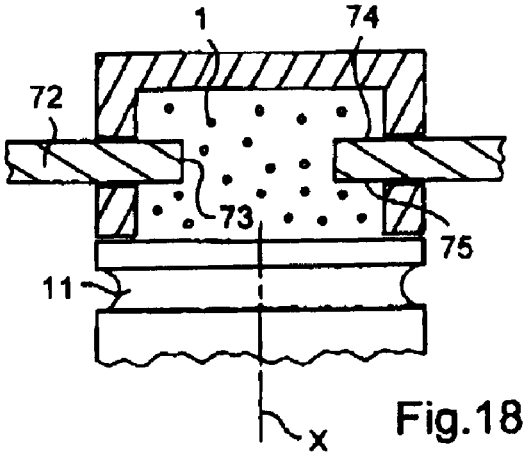
FIGS. 18 and 19 show other examples of peening installations.

FIG. 18 shows the possibility of treating a hole 73 together with the two inlet faces 74 and 75 of the part 72.

Figure 19:
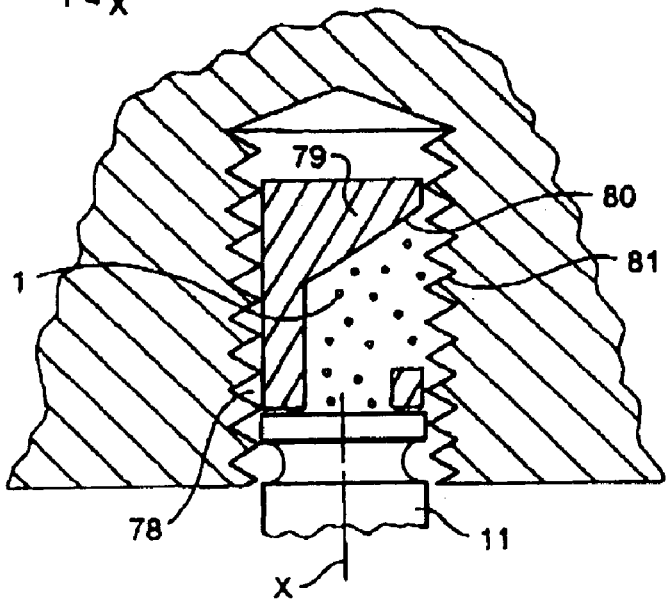

FIG. 19 shows the possibility of peening a tapped hole 78 by inserting therein a deflector 79 defining at least part of a treatment chamber, presenting a wall 80 that slopes relative to the longitudinal axis X of the sonotrode 11, thereby enabling shot to be directed towards the threads 81 of the tapped hole 78.

In all of the above examples, a plurality of sonotrodes can be used simultaneously for treating a single part.

These various configurations can be applied statically. However, when the part is driven in rotation, it can be driven continuously, or intermittently.

Where appropriate, it is possible to use a mixture of shot of different natures and/or different dimensions.

The invention is not limited to the examples described above, and can be applied to any part used in aviation or in the automobile industry, in particular for blades, vanes, turbines, threads, slots for receiving blade roots, fastener members of all kinds, welding beads, coupling radii between a blade and a flow path, inter-disk pockets, etc.

Throughout the description, including in the claims, the term "comprising a" should be understood as being synonymous with "comprising at least one", unless specified to the contrary.

The characteristics of the various embodiments of the invention can be combined with one another.

In particular, the shot of FIGS. 1 and 3 can optionally be used in the examples of FIGS. 4 to 19.

The sonotrode of the example of FIGS. 4 to 5 can optionally be used in the examples of FIGS. 6 to 19.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A system for ultrasonically peening surfaces, the system comprising:

a sonotrode comprising a body material and a vibrating surface, the vibrating surface coated with a coating material having a hardness greater than the body material;

a treatment chamber, defined at least in part by the vibrating surface; and at least one piece of shot within the treatment chamber to be excited by the vibrating surface of the sonotrode, the at least one piece of shot having a hardness greater than or equal to 800 HV.

2. The system of claim 1, wherein the hardness of the coating material and the hardness of the at least one piece of shot are substantially similar.

3. The system of claim 1, wherein the at least one piece of shot comprises tungsten carbide.

4. The system of claim 1, wherein the coating material comprises tungsten carbide.

5. The system of claim 1, wherein the body material comprises titanium.

6. The system of claim 5, wherein the titanium is a forged titanium.

7. The system of claim 1, wherein the coating material is coated to a thickness of greater than or equal to 0.5 millimeter over a substantial portion of the vibrating surface.

8. The system of claim 7, wherein the coating material is coated to a thickness of greater than 0.9 millimeter.

9. The system of claim 1, wherein the at least one piece of shot is substantially spherical.

10. The system of claim 1, wherein the at least one piece of shot is composite, the at least one piece of composite shot comprising a core comprising a core material having a first hardness, and a shell substantially surrounding the core, the shell comprising a shell material having a second hardness, the second hardness being greater than the first hardness.

11. The system of claim 10, wherein the core material has a density greater than that of the shell material.

12. The system of claim 9, wherein a diameter of the at least one piece of shot is less than or equal to 1.2 millimeters.

13. The system of claim 1, further comprising a deflector.

14. The system of claim 13, wherein the treatment chamber is further at least partially defined by the deflector.

15. The system of claim 13, wherein at least a portion of the deflector comprises a conical shape.

16. The system of claim 13, wherein the deflector is configured to rotate during an operation of the vibrating surface.

17. The system of claim 13, wherein at least one surface of the deflector is aligned obliquely to the vibrating surface.

18. The system of claim 1, wherein the surfaces are associated with a hole.

19. The system of claim 18, wherein the surfaces comprise both an inside surface of the hole and an outside surface surrounding the hole.

20. The system of claim 1, wherein the at least one piece of shot has a hardness of approximately 1300 HV.

* * * * *